US005505454A

United States Patent [19]

Gagarin

[11] Patent Number: 5,505,454

[45] Date of Patent: Apr. 9, 1996

[54] GOLF SWING PRACTICE DEVICE

[76] Inventor: Andrew S. Gagarin, 4 Lighthouse Point Rd., Watch Hill, R.I. 02891

[21] Appl. No.: 416,055

[22] Filed: Apr. 4, 1995

Related U.S. Application Data

[63] Continuation-in-part of Ser. No. 241,295, May 11, 1994, Pat. No. 5,405,139.

[51] Int. Cl.[6] ..... A63B 69/36

[52] U.S. Cl. ..... 273/186.2; 273/193 B

[58] Field of Search ..... 273/186.2, 187.3, 273/187.4, 193 R, 193 B, 193 A; 446/320

[56] References Cited

U.S. PATENT DOCUMENTS

| | | | |
|---|---|---|---|
| 1,662,712 | 3/1928 | Mensing | 273/80 B |
| 5,110,375 | 5/1992 | Parsons | 273/84 R X |
| 5,310,380 | 5/1994 | Levy et al. | 446/320 X |
| 5,405,139 | 4/1995 | Gagarin | 273/186.2 |

*Primary Examiner*—George J. Marlo
*Attorney, Agent, or Firm*—Barry R. Blaker

[57] ABSTRACT

Disclosed herein is a golf swing practice device or training aid which aids a golfer in developing and/or maintaining the rhythm and dynamics of a proper swing based principally on the smooth application of an accelerating centrifugal force to the clubhead. The device includes a shaft having a lower portion and a grip disposed over its upper portion. An elongate tubular elastomeric member, whose bottom end may be weighted, is coaxially affixed to the lower portion of the shaft. At least a portion of the length of the tubular elastomeric member extends below the tip of the shaft, thereby being unsupported, and is stretchable in response to the centrifugal force imposed on the member during practice swinging of the device.

17 Claims, 5 Drawing Sheets

GOLF SWING PRACTICE DEVICE

CROSS-REFERENCES TO PRIOR APPLICATIONS

This application is a continuation-in-part of my prior application Ser. No. 08/241,295, filed May 11, 1994, which prior application is to be issued on Apr. 11, 1995, under U.S. Pat. No. 5,405,139.

FIELD OF THE INVENTION

This invention relates to a golf swing practice device designed to teach golfers of all levels of expertise as to how to correctly swing a golf club.

1. Background of the Invention

In order to master the game of golf it is necessary to have a proper swing which involves the coordinated movements of the body throughout the entirety of the swing; namely, the backswing, downswing and follow-through. Due to the complex dynamics of the overall golf swing and the focus of most instruction on its several individual components, only a very small percentage of the people pursuing the game are able to attain an effective, proper swing.

More specifically, the central element in a proper swing involves the acceleration of the clubhead with the smooth application of centrifugal force such that the clubhead meets the ball squarely and with maximum kinetic energy. What is needed is a practice device which will teach golfers the dynamics of a proper swing based on this principle.

In order to teach this type of swing the device should have several characteristics. It should be able to be swung in a manner similar to a standard golf club while at the same time accentuating the user's feel and awareness of the clubhead. The device should be able to be swung continuously back and forth so the user can develop proper rhythm and muscle memory and it should provide both visual and tactile feedback, in real time, so as to immediately inform the user throughout the swing as to whether or not a correct swing is being achieved. Once the user has mastered the correct swing in the above manner, the device should then be able to be swung starting from the normal stationary address position as is done with a real club. In addition, the device should be able to educate the golfer in achieving maximum clubhead speed at impact while maintaining proper swing mechanics since the ability to hit a ball a long distance is a central element of the game. Finally, the device should teach the golfer proper wrist release which is a central element in distance and control.

2. Description of the Prior Art

There have been many patented devices which attempt to teach a correct swing. Some of these devices are discussed below.

There are currently a number of weighted golf swing trainers on the market which employ a relatively stiff shaft and a weighted head, One such club is the ASSIST, by Matzie, covered by U.S. Pat. No. 4,511,147 (1985), to Olsen. In addition there are various doughnut shaped weights which may be slipped onto a standard golf club's shaft for warming up and practice swinging. The basic problem with this class of swing trainers is that the clubhead is rigidly attached to the shaft. Therefore, a golfer can improperly manipulate the shaft and clubhead during a swing while the device provides little or no feedback to indicate that anything is wrong. In addition, the fixed solid connection between the shaft and the head impairs the user's ability to learn the feeling of swinging the clubhead and thus learn a proper swing.

Next, there are a group of practice clubs with a flexible shaft and a weighted head. U.S. Pat. No. 4,118,033 (1978), to Miyamoto, describes a club with a flexible shaft comprising a composite core member with stranded steel wire and a weighted head. Further, U.S. Pat. No. 5,026,063 (1991), to Rhodes, is for a similar flexible club with a shaft of extruded tubular plastic. This type of swing trainer suffers from the same deficiency as those with stiff shafts in that the clubhead and the shaft form an integral solid unit. As with the clubs mentioned earlier they, too, can be improperly manipulated and provide little or no feedback to indicate whether or not the clubhead is being swung with centrifugal force in the proper manner.

Furthermore, while the swing trainers described above may be somewhat distinguished by their degree of lateral flex, none of them are elastic along their longitudinal axes so that they are able to stretch when swung. It has been found that the ability of the elongate tubular elastomeric member to stretch in response to the centrifugal force applied to it during a swing dramatically increases the student's ability to feel the clubhead and as a result quickly learn a proper swing.

At the other end of the spectrum of flexibility there is the trainer embodied in U.S. Pat. No. 4,664,388 (1986), to Huber. This is a practice device comprising a ball suspended by an inelastic cord from the end of a shaft. The ball in this device cannot be manipulated through the shaft and must, therefore, be swung with pure centrifugal force. However, it is extremely difficult to learn to swing this device properly for if centrifugal force is not continuously applied to the ball throughout the swing, the string collapses. Thus, the learning time for this practice device is generally rather lengthy and often constitutes a source of discouragement, particularly to novice golfers. Even in the best case, if the student can learn to properly swing the device, the ball hits the student both on the backswing and follow-through which is at the least distracting, if not dangerous.

THE PRIOR APPLICATION

In my parent application there is disclosed and claimed a golf swing practice device comprising an golf club shaft having upper and lower portions, a golf grip being disposed over, affixed to and defining the upper portion. An elongate tubular flexible elastomeric member having a length substantially greater than the lower portion of the shaft is disposed over said lower portion, the upper end of the tubular member being affixed to the shaft at a location substantially adjacent the grip. Therefore, in the resting condition the lower end of the elongate tubular elastomeric member extends beyond the tip of the shaft disposed therewithin. The elongate tubular elastomeric member is of stretchable character such that it is enabled to elongate in response to centrifugal forces imposed thereon during practice swinging of the device. In a preferred embodiment, the lower end of said tubular member is provided with a weight.

This practice device has been found to be a great boon to golfers attempting to learn proper swing dynamics in that it is easy to use and it instantaneously informs the user of swing imperfections during any phase of the swing through tactile and/or visual feedback. Thus, use of the device can substantially shorten the time required for a novice golfer to learn proper basic swing dynamics or, in the case of an advanced golfer, to correct those swing imperfections which may have inadvertently crept into his or her swing. It has been further found that the device constitutes an excellent warm-up tool for use before actual play because, unlike a conventional club, it immediately informs the golfer of swing imperfections during such warm-up and thus allows the golfer to quickly and affirmatively correct them prior to play.

I have now discovered that many of the advantages of the practice golf swing device of my prior application can be had when the upper end of an elongate tubular stretchable elastomeric member is coaxially attached to said lower portion of said shaft at substantially any location along its length.

OBJECTS OF THE INVENTION

It is the principal object of this invention to provide a novel golf swing practice device which will teach a golfer of any level of expertise a proper golf swing based on centrifugal force.

Another object of this invention is to provide a golf swing practice device which expedites the learning process because it can be swung either continuously back and forth, or from the address position.

Another object of this invention is to provide a golf swing practice device which will aid the learning process by providing both visual and tactile feedback throughout all dynamic phases of the swing so the user becomes instantly aware of whether or not it is being swung correctly.

A further object of this invention is to provide a golf swing practice device which will educate the user in the proper body and arm motions required to swing with more power.

A still further object of this invention is provide a golf swing practice device which will educate the user in proper wrist release, and full extension of the arms.

Other objects and advantages of the present invention will in part be obvious and will in part appear hereinafter.

SUMMARY OF THE INVENTION

In view of the foregoing, this invention is a new and improved practice device and training aid for quickly learning and/or restoring the dynamics of a proper golf swing.

The practice device of the invention comprises a shaft having upper and lower portions, a golf grip being disposed over, affixed to and defining the upper portion thereof. An elongate tubular flexible elastomeric member having upper and lower ends is coaxially affixed by its upper end to the lower portion of the shaft at substantially any point along its length, the lower end of said tubular elastomeric member extending substantially beyond the tip of the lower portion of said shaft. Said tubular elastomeric member is stretchable so as to elongate in response to centrifugal forces imposed thereon during practice swinging of the device. In a preferred embodiment of the invention a weight, which is preferably in the nature of a ball, is attached to the lower end of the tubular elastomeric member.

REFERENCE NUMERALS IN DRAWINGS

Figure 1:
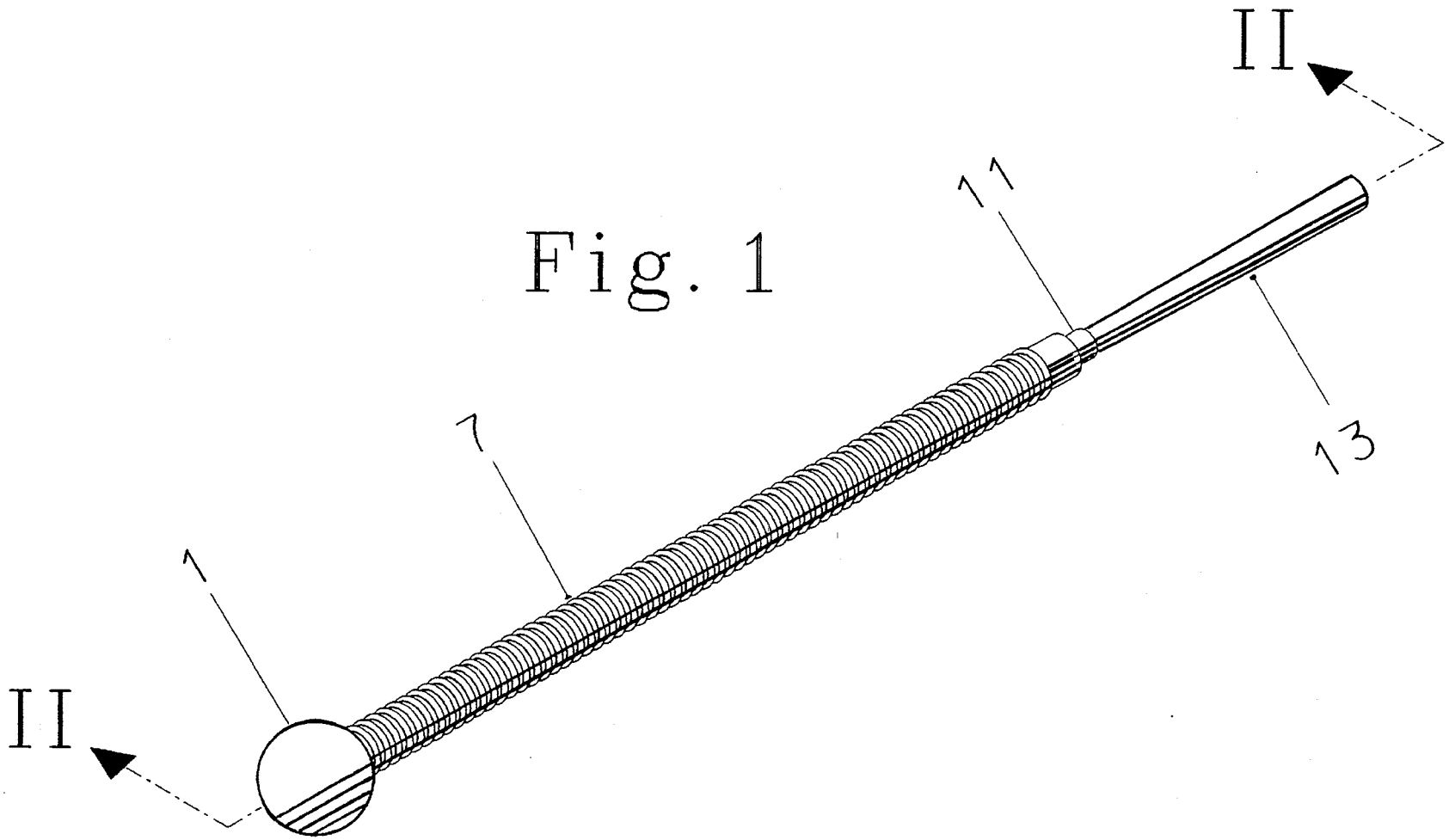
FIG. 1 is a perspective view of a golf swing practice device in accordance with one embodiment of the invention.

1. ball
2. weight
3. hollow wall anchor
4. eyebolt
5. bushing
6. tension pin
7. tubular elastomeric member
8. shaft
9. plastic cap
10. internal bushing
11. fixed bushing
12. tension pin
13. grip
14. ½ inch PVC pipe

DESCRIPTION OF THE PREFERRED EMBODIMENT(S)

Referring to the drawings, wherein like reference numerals refer to like structures, the golf swing practice device of the invention broadly comprises a golf club shaft 8 having upper and lower portions and having coaxially affixed to said lower portion thereof the upper end of a tubular stretchable elastomeric member 7. The upper portion of the shaft 8 is defined by a golf grip 13 disposed thereover and affixed thereto, preferably by means of an adhesive or glue bond. The bottom end of the tubular elastomeric member 7 extends substantially beyond the tip of the lower portion of the shaft 8. Preferably, the bottom end of the tubular elastomeric member 7 is weighted and, of further preference, said weight comprises a ball 1 attached thereto.

The composition of the shaft 8 is generally non-critical and is, therefore, subject to considerable variation. Compositionally, the shaft may be of conventional tubular metal construction or may be composed of wood, plastic or a composite material. In terms of length, the shaft may be in the nature of a stubbie, say about 18 inches, up to full conventional length which, for male golfers, is generally between about 30 and 44 inches. Obviously, junior and female models of the practice device of the invention can employ shafts of proportionately shorter length.

As mentioned, the upper end of the tubular elastomeric member 7 is coaxially attached to the lower portion of shaft 8 at any point along the latter's length, including the tip thereof. In a preferred embodiment of the invention the upper end of the tubular stretchable elastomeric member 7 is affixed to the lower portion of the shaft 8 at a location spaced above the tip thereof and, where this is the case, a plastic cap 9 is additionally preferably affixed to the tip of the shaft. In this manner said cap 9 allows that portion of the length of said tubular elastomeric member 7 disposed over said lower portion of the shaft 8 to extend and contract without interference by the tip thereof.

In my prototypal embodiments of the device the stretchable tubular elastomeric member 7 employed was a standard vacuum cleaner hose for a Royal Dirt Devil model 192 hand vacuum, manufactured by the Royal Appliance Mfg. Co., Cleveland, Ohio. Three and one quarter inches of the hose nozzle and two inches of the opposite end were cut off to provide a tubular elastomeric member 7 having a total length of thirty seven inches. While the total length of the tubular elastomeric member may vary depending upon such parameters as its elasticity, the height of the user and the point of fixation of the upper end thereof to the lower portion of the shaft 8, its overall length should be sufficient to bring the lower end of said member in the resting state of the device to substantially below the tip of said lower portion of the shaft 8. While somewhat stiffer and less elastic than the vacuum cleaner hose mentioned above, either polyvinylchloride (PVC) or polyethylene 1¼" sump pump hose may also be used with good effect. Because the latter hoses are stiffer and less elastic than the previously mentioned vacuum cleaner hose, they are more suitable for use as the tubular elastomeric member 7 in a golf swing practice device designed for a large man or one with a high swing speed. Also generally suitable for use as the tubular elastomeric member 7 element of the invention are various stretchable tubular elements constructed of true elastomers such as natural rubber, silicone rubber, polyurethane rubber or thermoplastic rubbers (TPR), particularly those tubular element constructions formed of such true elastomers and additionally comprising integral circumferential reinforcing elements such as a helical spring wire element. It is envisaged that the device of the invention may be manufactured and sold in kit form, with several interchangeable tubular elastomeric members 7 having differing lengths and/or spring rates, each being selectively affixable to the shaft 8.

Figure 2:
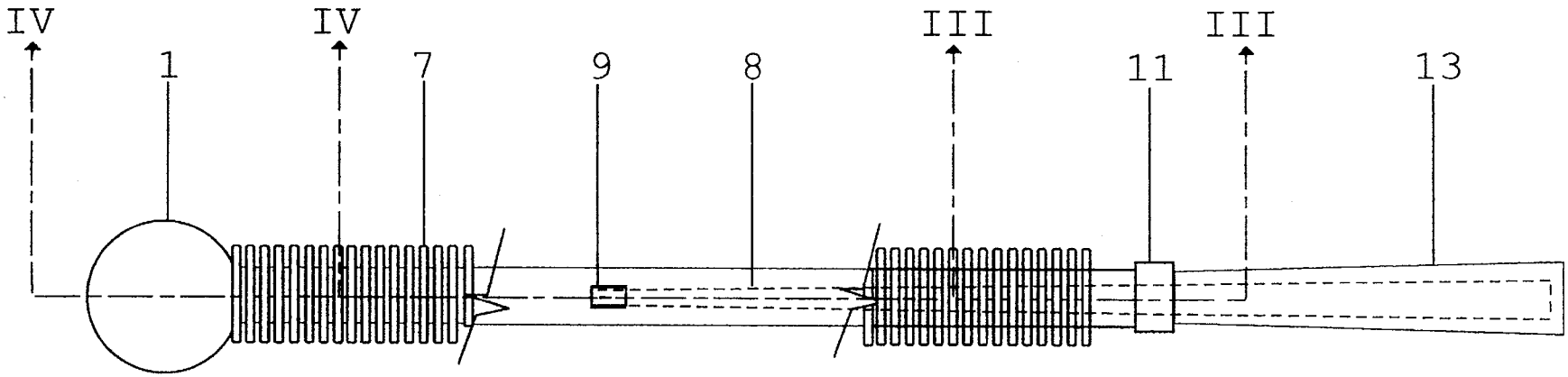
FIG. 2 is a partially sectional side view of the device of FIG. 1, taken along lines II—II thereof.
Figure 5:
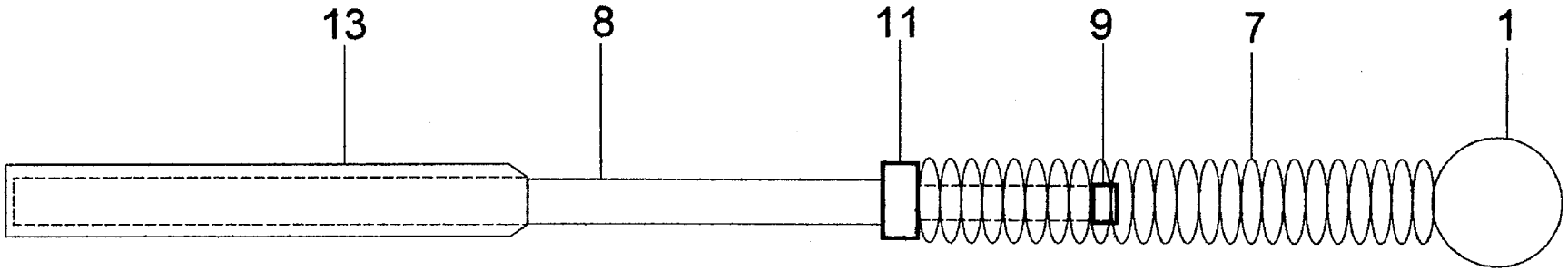
FIG. 5 is a partially sectional side view of another embodiment of the device of the invention.

As mentioned, the upper end of the tubular elastomeric member 7 is coaxially affixed to the lower portion of the shaft 8 at any point along the length thereof, including at the tip. However, it is preferred that said upper end be affixed to the lower portion of the shaft 8 at a location spaced substantially above the tip thereof, thereby to cause the tip of said lower portion to extend coaxially into the bore of the tubular elastomeric member 7. Accordingly, in the embodiment of the invention shown in FIGS. 1 through 3 the upper end of the elastomeric tubular member 7 is attached to the lower portion of the shaft 8 substantially adjacent the grip 13 while in the embodiment shown in FIG. 5 said attachment is shown to occur remote from the grip, but substantially above the tip of the shaft 8. Desirably, the length of the lower portion of the shaft 8 which extends inside the tubular elastomeric member 7 will be sufficient to provide internal support for said tubular member 7 and to thereby prevent said member from collapsing completely and hitting the user during at the pause at the top of the backswing and/or at the end of the follow-through. Generally speaking, this function can be effectively served when the upper end of the tubular member 7 is attached to the lower portion of the shaft 8 at least about four inches above the tip thereof.

Whatever may be the precise location of the point of attachment of the upper end of the tubular elastomeric member 7 to the lower portion of the shaft 8 along its length, however, the length of said tubular member 7 should be such that a substantial length of the terminal end portion thereof depends unrestrained from the tip of the shaft 8 in order that said terminal end portion be free to flex in all planes and to extend longitudinally in response to centrifugal force applied thereto by a golfer's swing. In general, the length of the elastomeric tubular member 7 should be sufficient to locate the bottom end thereof at least about four inches beyond the tip of the lower portion of the shaft 8. Where the length of the elastomeric tubular member 7 is excessive, however, e.g., wherein the bottom end thereof depends by more than about twenty inches below the tip of the bottom portion of the shaft 8, the result can be that said terminal portion of the tubular member 7 will be excessively flaccid and unsupported and can thus tend to strike the user during the start of the swing and/or at the normal pauses at the top of the backswing and upon follow-through. In general, it is preferred that the tubular member 7 be of length such that the bottom end thereof is located between about six and about twelve inches below the tip of the lower portion of the shaft element 8.

Figure 3:
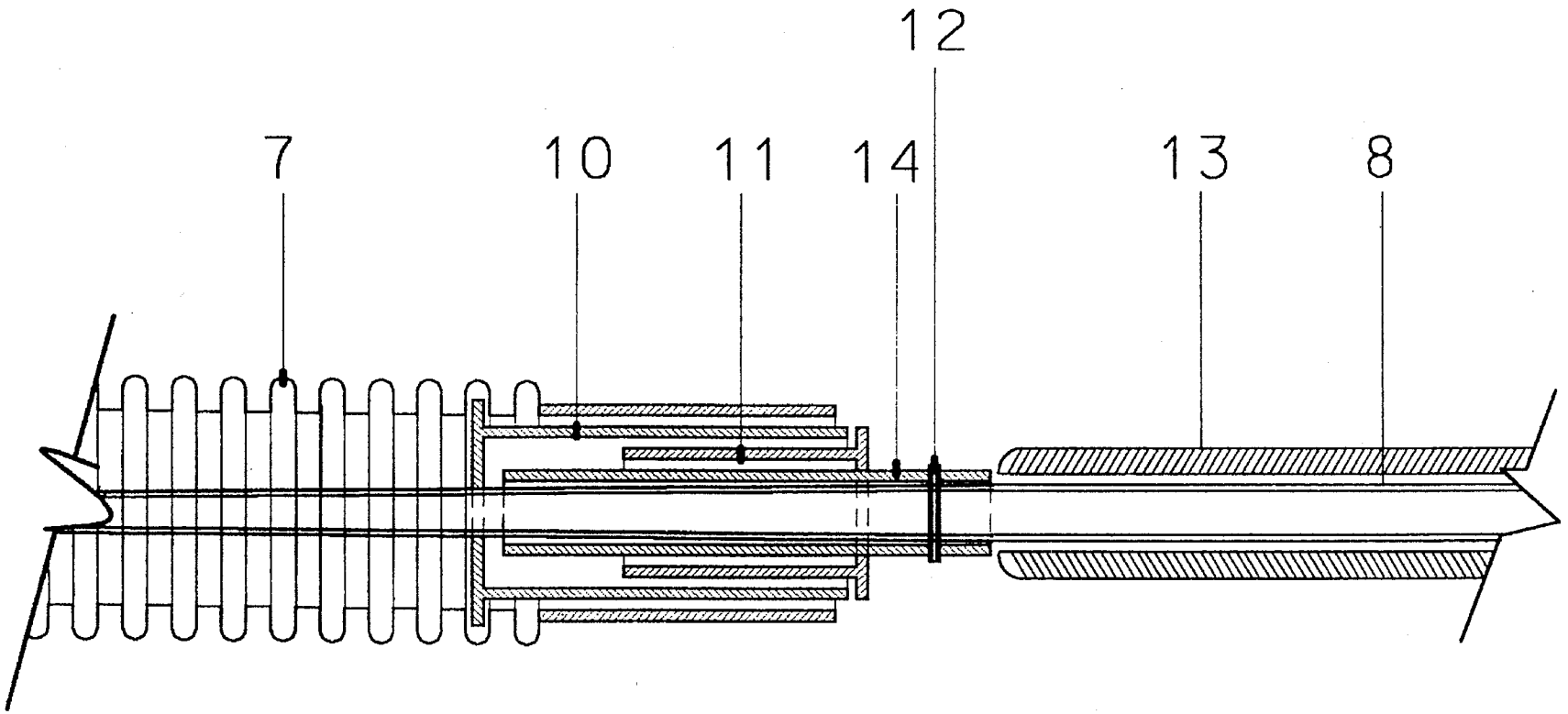
FIG. 3 is a enlarged sectional view of a mid-portion of the device of FIG. 2, taken between lines III—III thereof.

In FIG. 3 hereof there is shown one exemplary arrangement by which the upper end of the elastomeric tubular member 7 may be suitably attached to the lower portion of the shaft 8. Referring now to said FIG. 3, the standard Red Devil model 192 corrugated vacuum hose, which is illustrative in this instance as the tubular elastomeric member 7, is manufactured with an internal plastic bushing 10 having a raised lip on one end. The lip of the bushing engages in the ribbed portion of the tubular elastomeric member 7 allowing said member to rotate freely thereabout while preventing it from being withdrawn therefrom. A standard ¾" to ½" PVC reducing bushing 11 is cemented to the internal bushing 10. A piece of standard ½ inch PVC pipe 14 or a pipe of a suitable internal diameter is cemented inside the bushing 11 so that the resulting assembly will fit snugly onto the shaft 8. The pipe 14 is then secured to the shaft 8 with a tension pin 12. This allows the resulting assembly defined by the combination of tubular elastomeric member 7, bushing 10, bushing 11 and pipe 14 to be changed or replaced by, seriatim, removing tension pin 12, removing the existing assembly, inserting a replacement assembly over the shaft 8 and repinning the replacement assembly to the shaft 8 by means of the tension pin 12. In those models of the device of the invention wherein it is not anticipated that the tubular elastomeric member 7 will be changed, the pipe 14 of the assembly may be permanently attached to the shaft 8, such as by bonding it thereto with an epoxy glue.

It is desirable that the attachment of the upper end of the tubular elastomeric member 7 to the lower portion of the shaft 8 be journalled such as to provide said member 7 with the ability to freely rotate about the shaft 8. This rotational capability is beneficial because it isolates the tubular member from improper rotational inputs from the user's hands and allows the terminal end portion of said tubular member 7 to always droop straight down in line with the shaft so the user may take a proper grip without the terminal end portion of the tubular elastomeric member 7 applying a torsional force to the shaft 8.

Figure 4:
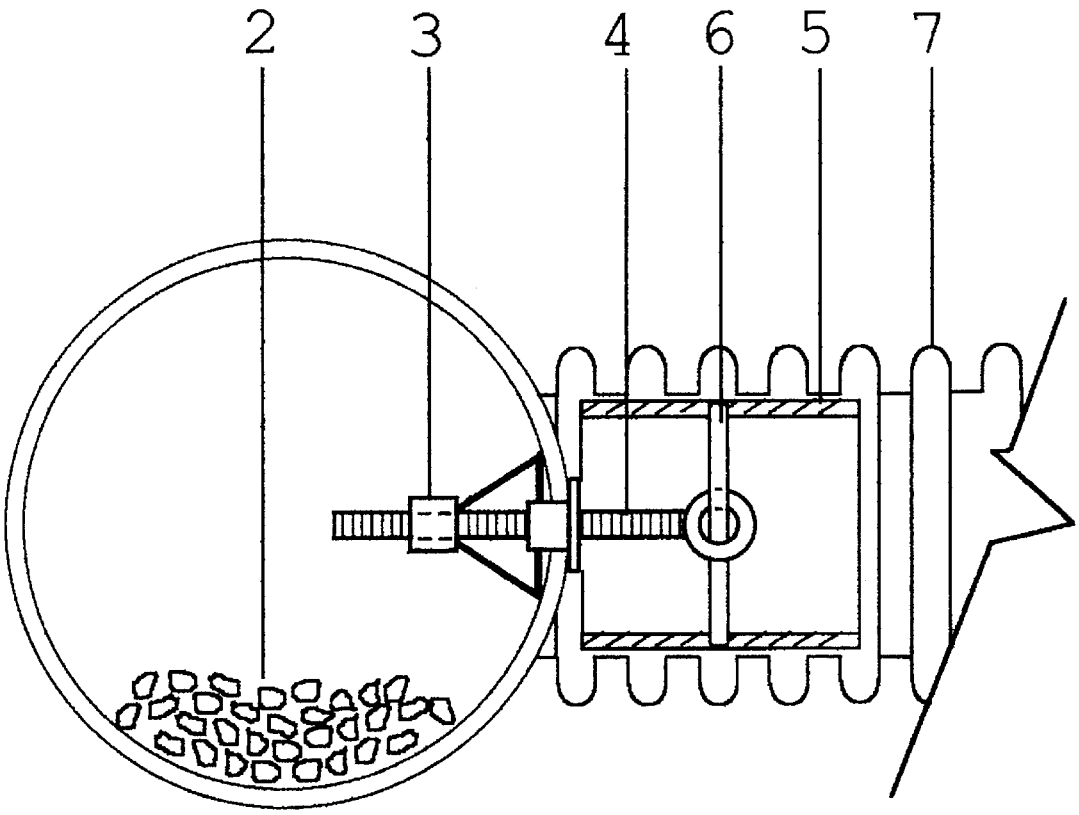
FIG. 4 is an englarged sectional view of a lower portion of the device of FIG. 2, taken between lines IV—IV thereof.

While the golf swing practice device thus far described will itself function adequately, performance is greatly improved if some additional weight is added to the bottom end of the tubular elastomeric member 7. One arrangement for achieving such weighting of the bottom end of the tubular elastomeric member 7 is depicted in FIG. 4. Accordingly, referring now to said FIG. 4, bushing 5 is made of standard ¾" PVC pipe. A hole is drilled in the bushing to accept tension pin 6 which holds a threaded eyebolt 4 in place. The bushing 5 is then glued inside the bore of the bottom end of tubular elastomeric member 7. A hollow spherical ball 1 is fitted with a conventional hollow wall anchor 3. The ball 1 is attached to the bottom end of the tubular elastomeric member 7 by screwing the eyebolt 4 into the hollow wall anchor 3. A weight 2 in the form of sand, shot or other similar particulate solid material is added to the ball 1 by pouring it through the hole in the center of the hollow wall anchor 3 when it is unscrewed from the eyebolt 4. The overall weight of the combination of the ball 1, hollow wall anchor 3, eyebolt 4 and weight 2 will ordinarily fall within the range of from about one to about twelve ounces. The overall weight of this combination may be changed at any time by unscrewing the wall anchor 3 from the eyebolt 4 and either adding or withdrawing the particulate material of weight 2 through the hole in the hollow wall anchor 3. This feature allows the weight of the ball 1 to be customized to produce the maximum feel for different types of the elastomeric tubular members 7 having differing coefficients of elasticity and/or spring rates. In addition, the weight of said ball 1 may be varied in relation to the size and swing speed of the of the user.

The overall length of the device for adult male golfers should ordinarily fall within the range of from about forty to about fifty two inches depending, for instance, on the elasticity of the tubular elastomeric member 7 being used and the size person for whom the device is designed. Although tests have shown that golf swing practice devices of the invention several inches longer than the standard driver length of 44" tend to maximize the feel of the clubhead and produce the steepest learning curve in the majority of male golfers, proportionately shorter devices are also operable. It is anticipated that, in the future, several models will be produced in shorter lengths, including a junior model.

A student golfer first using this swing trainer is instructed to swing the device back and forth repetitively and in such a way that the ball 1 and tubular elastomeric member 7 extend straight out from the grip 13 and the ball 1 does not hit the ground. In this manner the student is able to guickly learn proper swing rhythm and dynamics using pure centrifugal force because the ball 1 will extend straight out and avoid hitting the ground only if the device is swung by smoothly accelerating the ball 1 with centrifugal force. Any attempted manipulation of the device or any jerky movement thereof during the course of the downswing will result in the ball 1 either striking the ground or not extending straight out from the grip 13. Thus, immediate feedback is provided to the user so that the swing can be immediately adjusted to achieve the desired result.

The ability of the student to learn quickly is further aided in the preferred embodiment of the invention wherein the upper end of the tubular elastomeric member 7 is affixed to the lower portion of shaft 8 at a location substantially above the tip thereof. In this embodiment the upper portion of the tubular elastomeric member 7 overlying the shaft 8 is provided with internal support by that portion of the shaft 8 residing within the bore thereof. Thus, unlike a string, the upper portion of the tubular member 7 is prevented from collapsing when the ball changes direction at the end of the foreswing and backswing.

Moreover, in the golf swing practice device of the invention substantially the entire length of the tubular elastomeric member 7 extends or stretches in response to centrifugal force imparted thereto by the golfer's swing. This causes the golfer to feel the sensation that the "head" of the device is pulling the hands outwardly in the plane of the swing, thereby encouraging a full extension of the arms and the widest pure arc of which the golfer is capable.

As the device is swung through the imaginary hitting area the momentum of the ball 1 forces the golfer to have a proper wrist release. If the user hesitates in releasing the wrists through the hitting area the ball 1 begins to lead the shaft 8 and tubular elastomeric member 7. This condition is immediately apparent to the golfer and corrective action to avoid the condition can be quickly achieved and reinforced in the golfer's mind and muscle memory. Furthermore, the weighted ball 1 acts similarly to a weight on the end of a fulcrum, thereby encouraging the golfer to employ a correct wrist release.

After the golfer has swung the device for several minutes, he is asked to try and swing it harder. It is immediately apparent that the practice device of the invention can only be accelerated with the smooth application of power coming from the lead shoulder area of the golfer which, for a right-handed golfer, is the left shoulder. Any attempted premature acceleration of the golf swing practice device of the invention with the hands from the top of the backswing results in the ball 1 hitting the ground. This common swing error is generally termed "hitting from the top". The immediate feedback of the ball hitting the ground, coupled with the increased feel of the "clubhead" provided by the stretchable tubular elastomeric member 7, aid the user in quickly identifying and correcting this fault.

Although the present invention has been described in connection with various preferred embodiments thereof, many variations, equivalents and modifications will now become apparent to those skilled in the art without departing from the essential scope and spirit thereof. Accordingly, it is intended that the present invention be limited not by the specific disclosure herein, but only by the appended claims.

What is claimed is:

1. A golf swing practice device comprising:

a golf shaft having upper and lower portions, said upper portion being defined by a golf grip disposed over and affixed thereto and said lower portion ending in a tip;

an elongate flexible tubular elastomeric member having upper and lower ends, said upper end of said tubular member being coaxially affixed to said lower portion of said shaft, said tubular member being of a length such that said bottom end thereof depends substantially below said tip, said tubular elastomeric member further being stretchable so as to elongate in response to centrifugal forces imposed thereon during practice swinging of the device.

2. The device of claim 1 comprising, in addition, a weight affixed to said lower end of said elongate tubular elastomeric member.

3. The device of claim 2 wherein said weight comprises a ball.

4. The device of claim 3 wherein said ball is hollow and contains a weighty particulate material therein.

5. The device of claim 2 wherein said weight is adjustable.

6. The device of claim 1 wherein said coaxial affixation of the upper end of said tubular elastomeric member to said lower portion of said shaft is journalled such that said tubular elastomeric member is free to rotate relative to said shaft.

7. The device of claim 1 wherein said tubular elastomeric member is a corrugated hose.

8. The device of claim 1 wherein the upper end of said tubular elastomeric member is affixed to said lower portion of said shaft at a location substantially above the tip thereof.

9. The device of claim 8 wherein the upper end of said tubular elastomeric member is affixed to said lower portion of said shaft at a location at least about four inches above the tip thereof.

10. The device of claim 1 wherein said tubular elastomeric member is of a length such that the bottom end thereof depends between about 6 and about 12 inches below the tip of said lower portion of said shaft.

11. The golf swing practice device of claim 1 comprising a plurality of said flexible elastomeric tubular members and means to selectively, individually and detachably affix the upper end of each of said plurality of tubular members to said lower portion of said shaft.

12. The device of claim 11 comprising, in addition, a weight affixable to the lower end of each of said plurality of tubular elastomeric members.

13. The device of claim 12 wherein said weight is adjustable.

14. The device of claim 11 wherein said means to selectively, individually and detachably affix the upper end of each of said plurality of elastomeric tubular members to the lower portion of said shaft is journalled such that the elastomeric tubular member affixed to said lower portion of said shaft therewith is free to rotate about the longitudinal axis of said shaft.

15. The device of claim 11 wherein each of said plurality of tubular elastomeric members is a corrugated hose.

16. The device of claim 11 wherein said plurality of tubular elastomeric members include members of differing spring rates.

17. The device of claim 11 wherein said plurality of tubular elastomeric members include members of differing lengths.

* * * * *

UNITED STATES PATENT AND TRADEMARK OFFICE

CERTIFICATE OF CORRECTION

PATENT NO. : 5,505,454

DATED April 9, 1996

INVENTOR(S) : Andrew S. Gagarin

It is certified that error appears in the above—identified patent and that said Letters Patent is hereby corrected as shown below:

In the heading of the patent the "Date of Patent" should appear as -- * April 9, 1996 --. In the heading of the patent, following identification of the inventor, insert -- [*] Notice: The portion of the term of this patent subsequent to April 11, 2012 has been disclaimed. --.

Signed and Sealed this

Sixteenth Day of July, 1996

Bruce Lehman

*Attest:*

BRUCE LEHMAN

*Attesting Officer*

*Commissioner of Patents and Trademarks*